US008651335B2

(12) United States Patent
Faneca Llesera

(10) Patent No.: US 8,651,335 B2
(45) Date of Patent: Feb. 18, 2014

(54) TAMPER EVIDENT NOZZLE SHIELD AND METHODS FOR USING THE SAME

(75) Inventor: Oscar Faneca Llesera, Barcelona (ES)

(73) Assignee: MeadWestvaco Calmar, Inc., Richmond, VA (US)

( * ) Notice: Subject to any disclaimer, the term of this patent is extended or adjusted under 35 U.S.C. 154(b) by 592 days.

(21) Appl. No.: 12/527,996

(22) PCT Filed: Apr. 21, 2008

(86) PCT No.: PCT/US2008/061010

§ 371 (c)(1), (2), (4) Date: Aug. 20, 2009

(87) PCT Pub. No.: WO2008/131331

PCT Pub. Date: Oct. 30, 2008

(65) Prior Publication Data

US 2010/0018997 A1 Jan. 28, 2010

Related U.S. Application Data

(60) Provisional application No. 60/913,470, filed on Apr. 23, 2007.

(51) Int. Cl.
*B67B 1/00* (2006.01)
*B65D 88/54* (2006.01)

(52) U.S. Cl.
USPC ..... 222/153.06; 222/153.14; 222/321.7; 222/321.9

(58) Field of Classification Search
USPC ..... 222/153.06, 153.05, 153.07, 153.13, 222/562, 321.7, 321.9, 384, 372, 153.04, 222/153.14
See application file for complete search history.

(56) References Cited

U.S. PATENT DOCUMENTS

| | | | | | |
|---|---|---|---|---|---|
| 3,251,209 | A * | 5/1966 | Cookson | 72/181 |
| 3,370,757 | A * | 2/1968 | Foster | 222/153.07 |
| 3,877,598 | A * | 4/1975 | Hazard | 215/224 |
| 4,170,315 | A * | 10/1979 | Dubach et al. | 220/281 |
| 4,506,805 | A * | 3/1985 | Marcon | 222/153.13 |
| 4,718,567 | A * | 1/1988 | La Vange | 215/216 |
| 5,662,246 | A * | 9/1997 | Contaxis, III | 222/153.07 |
| 5,975,370 | A * | 11/1999 | Durliat | 222/153.06 |
| 6,976,607 | B2 * | 12/2005 | Benoit-Gonin et al. | 222/153.06 |
| 2006/0043117 | A1 * | 3/2006 | Law et al. | 222/257 |

FOREIGN PATENT DOCUMENTS

| | | | |
|---|---|---|---|
| CN | 2340720 | | 9/1999 |
| DE | 202006003005 | U1 | 8/2006 |
| EP | 0401965 | A2 | 12/1990 |
| EP | 0457252 | A1 | 11/1991 |
| EP | 1754542 | A2 | 2/2007 |

OTHER PUBLICATIONS

Volpert Zeitler, "Anti-foreign-body device for a liquid container's pump has an anti-blocking device, top and bottom stoppers and an outlet tube." DE202006003005U1, published Aug. 24, 2006.

(Continued)

*Primary Examiner* — Kevin P Shaver
*Assistant Examiner* — Stephanie E Williams
(74) *Attorney, Agent, or Firm* — MeadWestvaco Intellectual Property Group

(57) ABSTRACT

A tamper evident nozzle shield (100) may be configured to fit a pump or pump dispenser to protect a fluid path (12) in the dispenser from contamination or to prevent or visually indicate if a dispenser or pump dispenser has been tampered with.

8 Claims, 8 Drawing Sheets

(56) References Cited

OTHER PUBLICATIONS

Michael Knickerbocker, Richard O'Neill, Douglas Dobbs., "Manually actuated dispensing pump sprayer having a removable nozzle locking element.." EP0401965A2, published Dec. 12, 1990.

Jeffrey Spencer, Robert Rohr, David Pritchett, "Airless dispensing pump with tamper evidence features." EP1754542A2, published Feb. 21, 2007.

Sario Buti, "Sprayer for liquids having guarantees against possible tampering." EP0457252A1, published Nov. 21, 1991.

Extended European Search Report for EP12174492, published Jan. 30, 2013.

International Search Report for WO2008131331A1, published Jul. 17, 2008.

* cited by examiner

TAMPER EVIDENT NOZZLE SHIELD AND METHODS FOR USING THE SAME

CROSS-REFERENCE TO RELATED APPLICATIONS

This application claims the benefit of U.S. Provisional Application No. 60/913,470 entitled "TAMPER EVIDENT NOZZLE SHIELD AND METHODS FOR USING THE SAME," filed Apr. 23, 2007, and the benefit of PCT Application PCT/US2008/061010 entitled "TAMPER EVIDENT NOZZLE SHIELD AND METHODS FOR USING THE SAME," filed Apr. 21, 2008, and incorporates each of the same herein by reference in their entireties.

BACKGROUND

1. Field of the Invention

The invention is generally related to caps for pumps and more particularly to dust caps, pump locks, and tamper evident devices for pump assemblies.

2. State of the Art

Fluid dispensers and pumps for fluid dispensers are well known. An example of a fluid dispenser or pump dispenser is illustrated in FIG. 1. The fluid dispenser includes an accumulator 30 which includes pump cylinder defining a pump chamber (not shown). The accumulator may be attached to a conventional closure cap 40 for mounting the dispenser to a container (not shown) of product to be dispensed.

The upper part of the dispenser includes a head 10 that when depressed typically moves the working parts of the pump (not shown) to pump fluid contents out a nozzle 12 or other delivery aperture. The head typically may have a head skirt 14 and an inner conduit (not shown). The head 10 and associated parts may sometimes be referred to as a plunger. Fluid is drawn into the accumulator from a container (not shown) through a dip tube 70.

Various means may be used to hold the pump head 10 in an extended or "lock-up" position or in a depressed or "lock-down" position. The user may move the pump head between these positions grasping head 10 and pushing, pulling, or twisting the head. Before purchase, "lock-up" and/or "lock-down" capability may be useful for preventing undesired use during shipping or handling.

Dispenser pump lock-up and lock-down features also useful after sale of a product, to prevent or accidental dispensing of the product. The user may engage such a feature for example before packing a dispenser into luggage, in order to prevent actuation of the pump during travel. Because the user must be able to easily switch between a lock-up or lockdown state, and a use state, the lock-up and lock-down features must not be too difficult to use. Because of this, a locking feature may be overcome for example by a curious customer who decides to try out the dispenser, without purchasing the product. An eventual purchaser may therefore purchase less than a full container, even without knowing this. A prospective purchaser, if aware or suspicious that a dispenser has been used, will probably not buy that dispenser, and a used dispenser may drip product on adjacent dispensers or other merchandise. Dispensers may also be subject to tampering. In addition, whether or not product is dispensed before purchase, the open end of the nozzle may permit dust, dirt, or other contamination to enter the nozzle.

Therefore, it would be desirable to provide a device, method, or mechanism for determining whether or not a dispenser has been tampered with prior to purchase. It may also be desirable to provide a device, method, or mechanism for ensuring that a pump remains in a "lock-up" or "lock-down" position until desired use. It may also be desirable to provide a cover or cap for a dispenser that may not be removed without indication that the cap or cover has been altered.

BRIEF SUMMARY OF THE INVENTION

According to certain embodiments of the invention, a tamper evident nozzle shield may include a dust cap configured to cover at least a portion of a dispenser pump head and a tamper evident structure that may visually indicate if the dust cap has been tampered with or otherwise removed in any portion from a dispenser upon which it is attached. In some embodiments, the dust cap may prevent contamination from entering a pump head or fluid path of a dispenser.

According to particular embodiments of the invention, a tamper evident structure may be torn, ripped, or otherwise destroyed when sufficient forces are applied to a dust cap or other structure attached to the tamper evident structure. The destruction of the tamper evident structure may provide a visual indication that the dispenser to which the tamper evident structure is attached has been compromised in some form. In some embodiments, a tamper evident structure may include a tab or other projection that may be pulled, torn, ripped, or otherwise removed from the tamper evident structure.

According to other embodiments of the invention, the tamper evident nozzle shield may also include a collar. A collar may be configured to help prevent the actuation of a dispenser or pump while the tamper evident nozzle shield is attached to the dispenser or pump. In some embodiments, the attempted removal of the collar from a dispenser or pump may also tear or otherwise destroy at least a portion of the tamper evident structure, providing a visual indication that the dispenser or the product in the dispenser may have been compromised.

BRIEF DESCRIPTION OF THE SEVERAL VIEWS OF THE DRAWINGS

While the specification concludes with claims particularly pointing out and distinctly claiming some embodiments which are regarded as the invention, the features of various embodiments of the invention can be more readily ascertained from the following detailed description of the invention when read in conjunction with the accompanying drawings, in which:

DETAILED DESCRIPTION OF THE INVENTION

Figure 1:
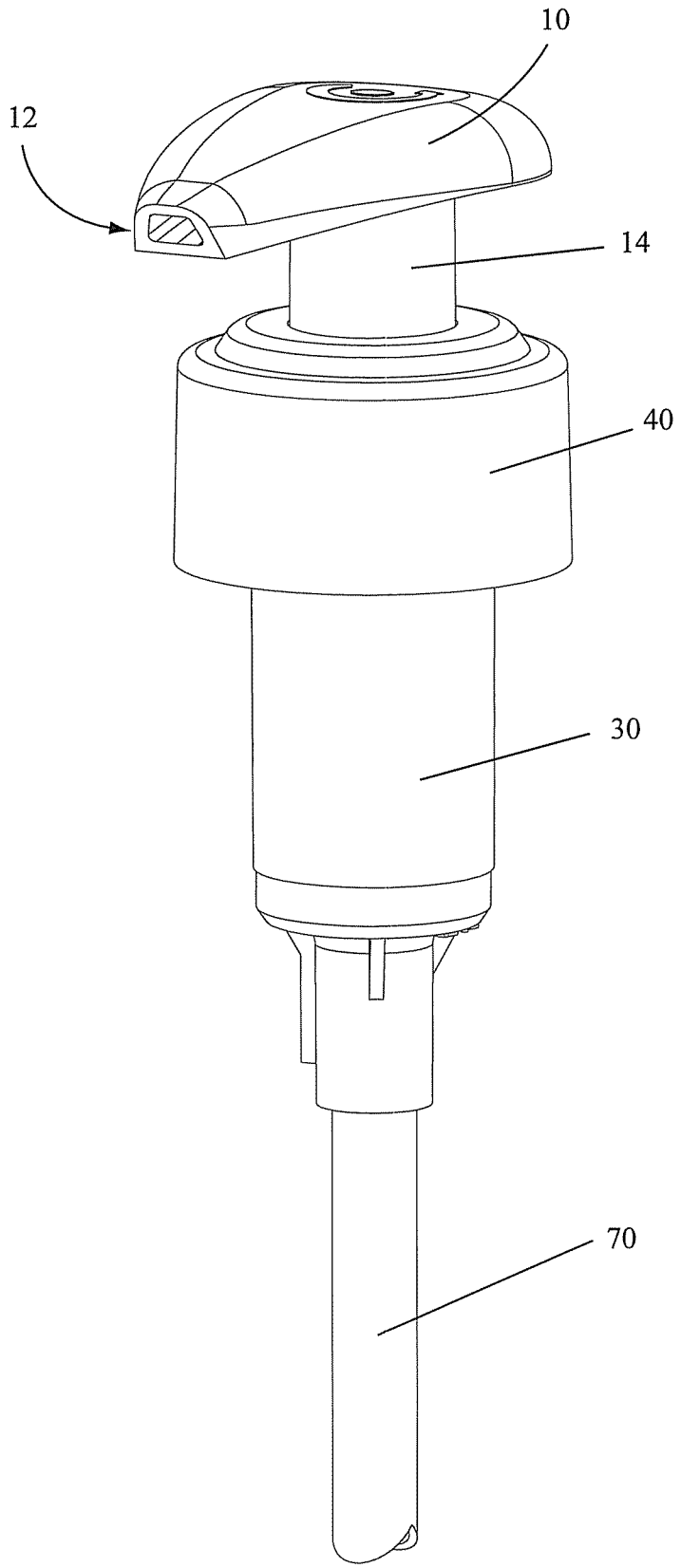
FIG. 1 illustrates a conventional pump dispenser.
Figure 2A:
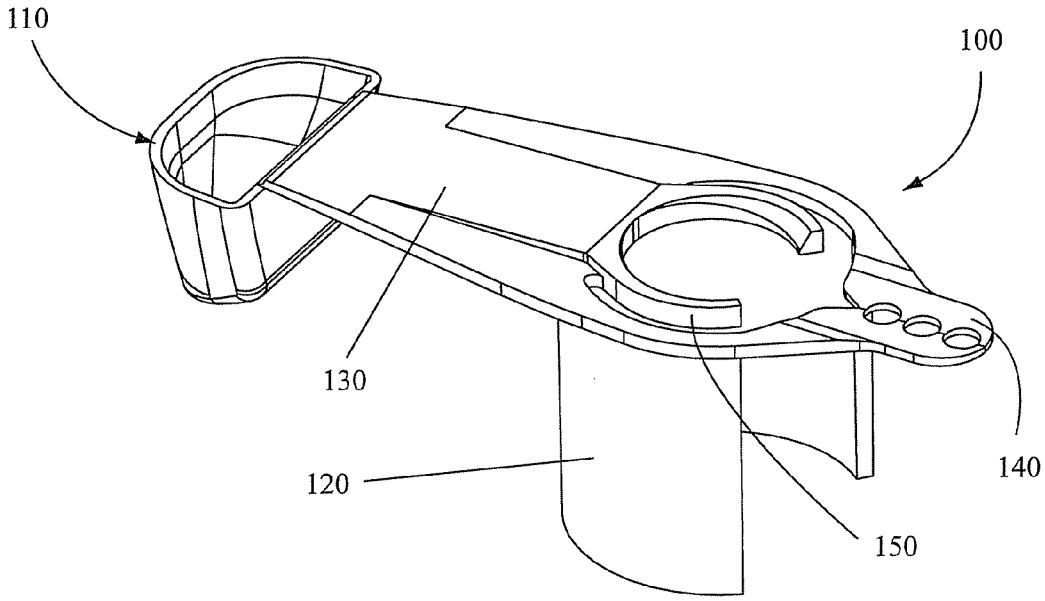
FIGS. 2A and 2B illustrate various perspective views of a tamper evident nozzle shield according to particular embodiments of the invention.
Figure 2B:
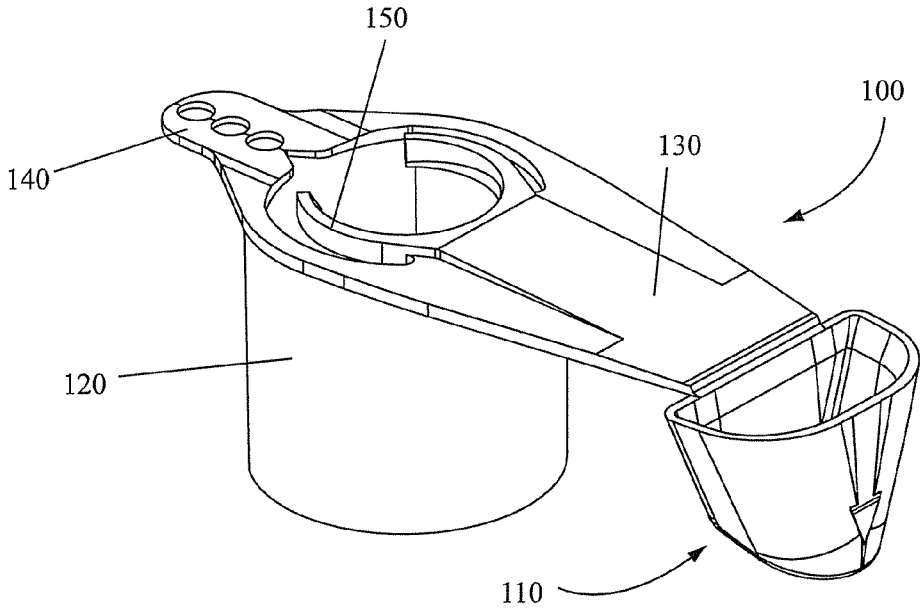

According to particular embodiments of the invention, a tamper evident nozzle shield 100 may include a dust cap 110, a collar 120, a connector 130 linking the dust cap 110 and collar 120 together, a tamper evident structure 140 and a retention ring 150 as illustrated in FIGS. 2A and 2B. The dust cap 110 may include any number of shapes and sizes such that the dust cap 110 may fit over, in, or both over and in a nozzle and may help to protect the nozzle from contamination. If the tamper evident nozzle shield 100 includes a collar 120, the collar may be shaped, sized, or otherwise configured to at least partially encompass a portion of a head skirt of a dispenser. The collar 120 and dust cap 110 may be connected by a connector 130 of any shape, size, or configuration. A retention ring 150 may also be included with a tamper evident nozzle shield. The retention ring 150 may be integrated with the collar 120, with the connector 130, or with both. A tamper evident structure 140 may also be integrated with the tamper evident nozzle shield. For example, as illustrated in FIGS. 2A and 2B, the tamper evident structure 140 may include a breakaway structure configured to rip, tear, or otherwise visually identify when a dispenser attached to the tamper evident nozzle shield 100 is activated or tampered with.

Figure 3A:
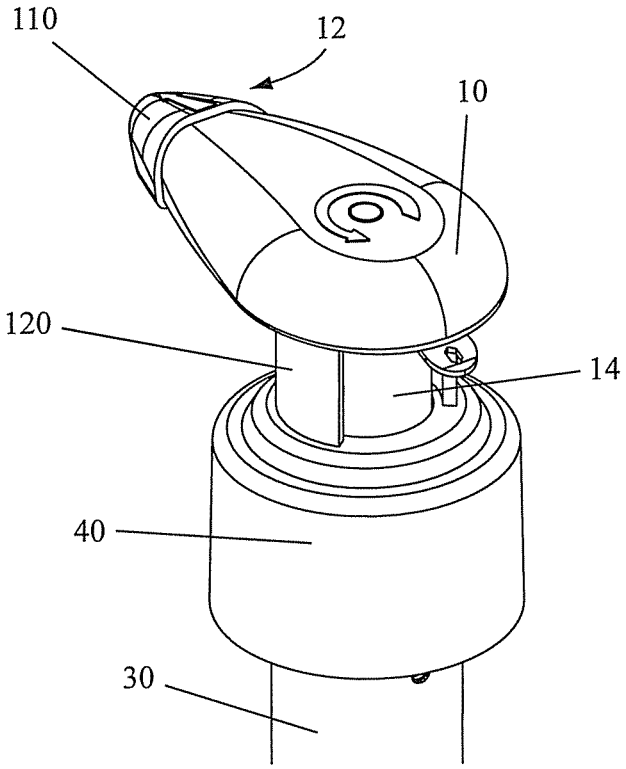
FIGS. 3A and 3B illustrate various perspective views of a tamper evident nozzle shield according to particular embodiments of the invention attached to a pump dispenser.
Figure 3B:
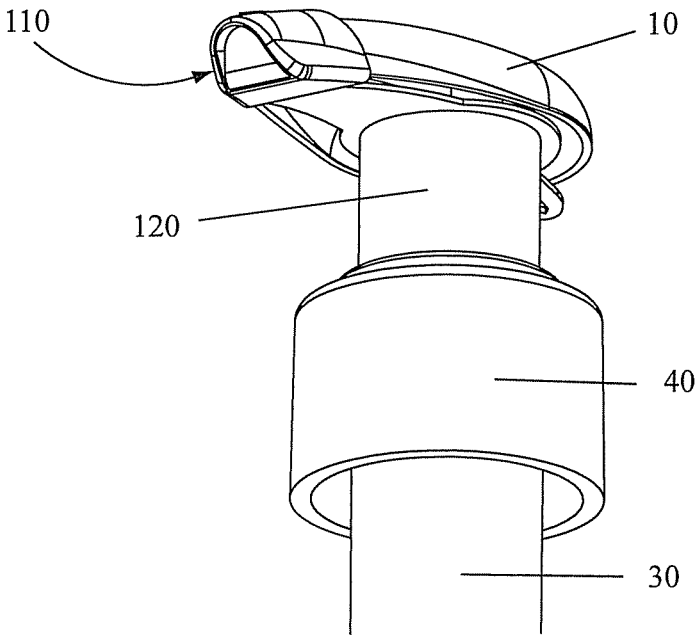

According to certain embodiments of the invention, a tamper evident nozzle shield 100 may be attached to a dispenser or pump as illustrated in FIGS. 3A and 3B. As illustrated, a dust cap 110 may be placed over at least a portion of the nozzle 12 of the dispenser. The positioning of the dust cap 110 over the nozzle 12 may protect the inside of the nozzle 12 from contamination. The dust cap 110 may be held in position over the nozzle 12 by a retention ring 150 encircling, or surrounding, at least a portion of a head skirt 14 of the dispenser. For example, the retention ring 150 may be removeably attached to the head skirt 14 of the dispenser such that tension is placed on the dust cap 110, which tension may help hold the dust cap 110 over the nozzle 12.

A connecting part 130 may also help to hold the dust cap 110 over the nozzle 12. As illustrated in FIGS. 3A and 3B, a connecting part 130 may link the dust cap 110 with the retention ring 150 and a collar 120. The connecting part 130 may include a strip, tether, lanyard, or other suitable shape or connector.

A collar 120 may be included as a part of the tamper evident nozzle shield 100. The collar 120 may be connected to, or may be an integral part of, the connecting part 130 or retention ring 150. A collar 120 may be shaped or configured to encircle at least a portion of a head skirt 14 of a dispenser. For example, the collar 120 illustrated in FIGS. 2A and 2B may be fitted around a head skirt 14 as illustrated in FIGS. 3A and 3B when the tamper evident nozzle shield 100 is attached to a dispenser. In some embodiments of the invention, the collar 120 may be designed to prevent downward motion of head 10 of a dispenser. The prevention of the downward motion of head 10 may prevent a pumping action from acting on the dispenser. Thus, actuation of the dispenser, or pump, may be hindered by the presence of the collar 120 around the head skirt 14. The use of a collar 120 may be especially beneficial where the tamper evident nozzle shield 100 is attached to a dispenser having a "lock-up" position because the collar may help prevent actuation of the dispenser pump while the tamper evident nozzle shield 100 is still attached to the dispenser.

Figure 4:
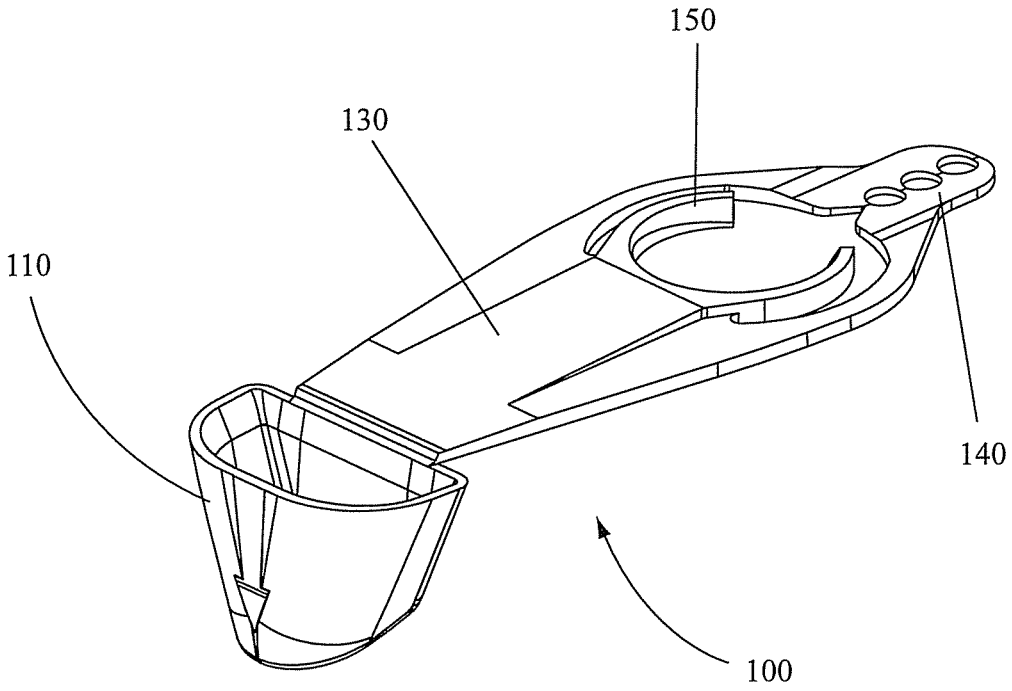
FIG. 4 illustrates a perspective view of a tamper evident nozzle shield according to various embodiments of the invention.

According to some embodiments of the invention, the tamper evident nozzle shield 100 may not include a collar 120 or may include a very thin collar 120 which may be an extension of the connecting part 130 as illustrated in FIG. 4. A collar 120 as illustrated in FIG. 4 may be used with various dispensers, including dispensers having a "lock-down" position.

Tamper evident nozzle shields 100 according to various embodiments of the invention may also include one or more tamper evident structures 140 which may be connected to the connecting part 130 as illustrated in FIGS. 2A through 4. In order for the dust cap 110 to be removed from the nozzle 12 when positioned over a nozzle 12 as illustrated in FIGS. 3A and 3B, the dust cap 110 must be pulled away from the nozzle 12 which may translate into a tensional force or other force being applied to the connecting part 130 and the tamper evident structure 140. The tamper evident structure 140 may be configured such that when sufficient forces are applied to the dust cap 110 to remove the dust cap 110 from the nozzle 12, the tamper evident structure 140 will tear or otherwise visually indicate that the integrity of the dust cap 110 protection may have been compromised. For example, the tamper evident structure 140 illustrated in FIGS. 3A and 3B includes a tab having a plurality of holes in the tab. As forces are applied to the dust cap 110 to remove the dust cap 110 from the nozzle 12, the forces are transferred into the connecting part 130 and into the tamper evident structure 140. As sufficient forces are applied to remove the dust cap 110 from the nozzle 12, the material in the tamper evident structure 140 between the plurality of holes may tear or otherwise break. The tearing of the material loosens the tension on the dust cap 110, allowing it to be removed and visually indicating that the integrity of the dust cap 110 over the nozzle 12 has been compromised.

According to some embodiments of the invention, the tamper evident structure 140 may include an angled opening which is configured to begin tearing the tamper evident structure 140 when a sufficient force is applied to the angled opening. In still other embodiments of the invention, the tamper evident structure 140 may be integrated with or may be a part of the collar 120, the connecting part 120, the dust cap 110, or the retention ring 150. For instance, a tamper evident structure including a plurality of holes may be formed in the connecting part 130 of the tamper evident nozzle shield 100 such that portions of the material between the holes in the connecting part 130 will tear or be otherwise altered, visually evidencing the tampering with of the device.

The tamper evident structure 140, if subjected to sufficient force, will at least partly tear permitting the dust cap 110 and the tamper evident nozzle shield 100 to be taken off the dispenser. Such an action will however break tamper evident structure 140 and leave a telltale indication that the dispenser has been used or tampered with.

Figure 6A:
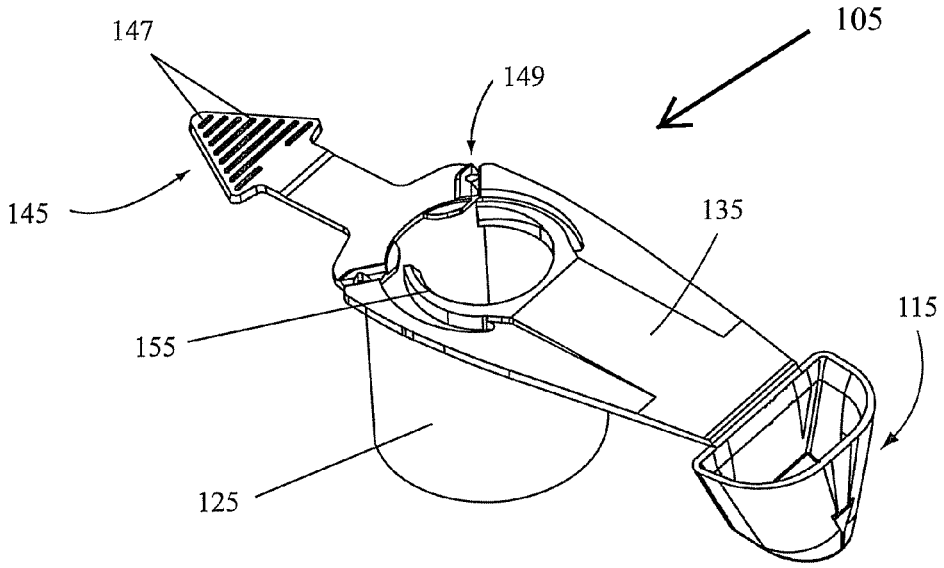
FIGS. 6A and 6B illustrate various views of a tamper evident nozzle shield according to particular embodiments of the invention.
Figure 6B:
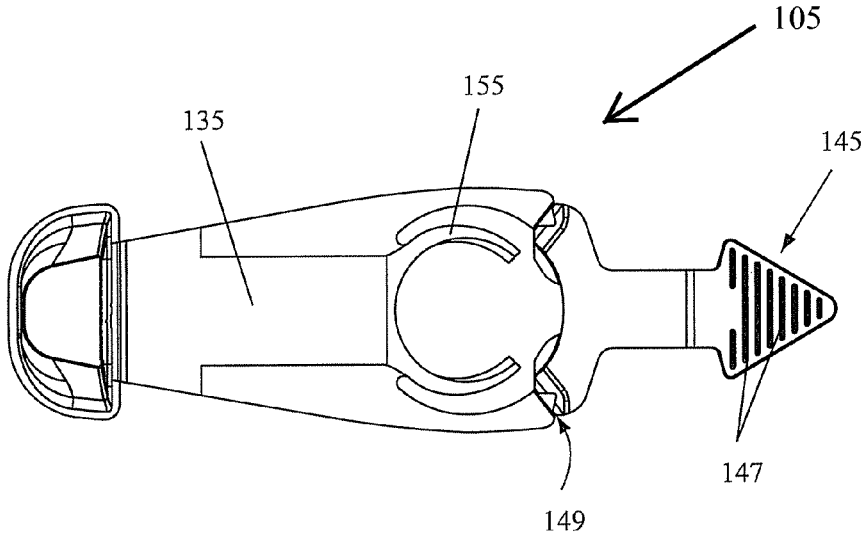

FIGS. 6A and 6B illustrate various views of a tamper evident nozzle shield 105 according to other embodiments of the invention. As illustrated in FIGS. 6A and 6B, the tamper evident nozzle shield 105 may include a dust cap 115, a connector 135, a collar 125, a retention ring 155 and a tamper evident structure 145. In some embodiments of the invention, the tamper evident structure 145 may include a pull-tab as illustrated in FIGS. 6A and 6B which may be separated from the tamper evident nozzle shield 105 by pulling, tearing, ripping, or otherwise applying force to the pull-tab of the tamper evident structure 145. For instance, the tamper evident structure 145 illustrated in FIGS. 6A and 6B includes a triangular or arrow-shaped structure that may be pulled or otherwise manipulated away from the connector 135. When sufficient force is exerted on the tamper evident structure 145, the tamper evident structure 145 may tear apart from the tamper evident nozzle shield 105. In some embodiments, one or more breakpoints 149 may be included in the tamper evident nozzle shield 105 to define tear points or breakpoints 149 for the tamper evident structure 145 to at least partially disengage from the tamper evident nozzle shield 105. The tamper evident structure 145 may also include ridges 147, indentations, bumps, or other features.

Figure 7:
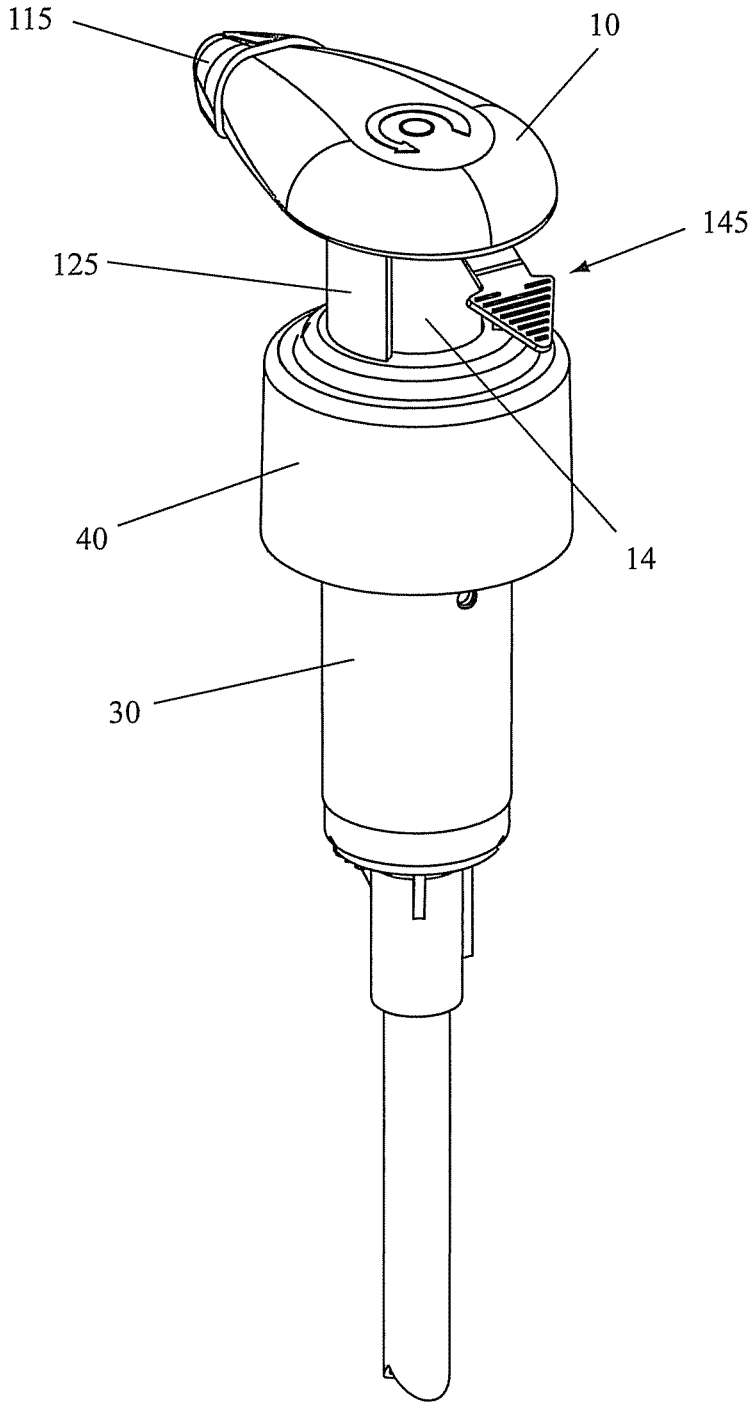
FIG. 7 illustrates a perspective view of a tamper evident nozzle shield according to particular embodiments of the invention attached to a pump dispenser.

A tamper evident nozzle shield 105 according to particular embodiments of the invention, and attached to a dispenser, is illustrated in FIG. 7. The tamper evident structure 145 may extend beyond the head 10 of the dispenser. The tamper evident structure 145 may be grasped and pulled, torn, ripped, or otherwise manipulated to separate or detach from the remainder of the tamper evident nozzle shield 105. For example, pulling on the arrow-shaped tamper evident structure 145 in the direction that the arrow-shape is pointing may cause the tamper evident structure 145 to detach from the tamper evident nozzle shield 105 at one or more breakpoints 149. The detachment or separation of the tamper evident structure 145 from the tamper evident nozzle shield 105 may indicate that the dispenser has been tampered with. In addition, separation or detachment of the tamper evident structure 145 from the tamper evident nozzle shield 105 may permit the removal of the tamper evident nozzle shield 105 from the dispenser. For instance, if the tamper evident structure 145 is detached from the tamper evident nozzle shield 105 at one or more breakpoints 149, the combination of the retention ring 155, collar 125, connector 135, and dust cap 115 may be slipped off of the dispenser. In addition, the combination of the retention ring 155, collar 125, connector 135, and dust cap 115 may be put or otherwise fitted back onto a dispenser as well.

According to embodiments of the invention, the tamper evident structure 145 may be shaped, formed, or otherwise structured to communicate information to a user. For example, the arrow-shaped tamper evident structure 145 illustrated in FIGS. 6A, 6B and 7 may indicate to a user that the tamper evident structure 145 can be pulled in the direction indicated by the arrow-shape.

As with other embodiments of the invention, the tamper evident nozzle shield 105 illustrated in FIGS. 6A, 6B, and 7 may be modified, altered, or otherwise shaped to fit a dispenser to which the tamper evident nozzle shield 105 is to be attached. The tamper evident nozzle shield 105 may also include or not include all of the illustrated parts. For instance, a tamper evident nozzle shield 105 according to embodiments of the invention may not include a collar 125. In other embodiments, a tamper evident nozzle shield 105 may not include a dust cap 115.

Figure 5A:
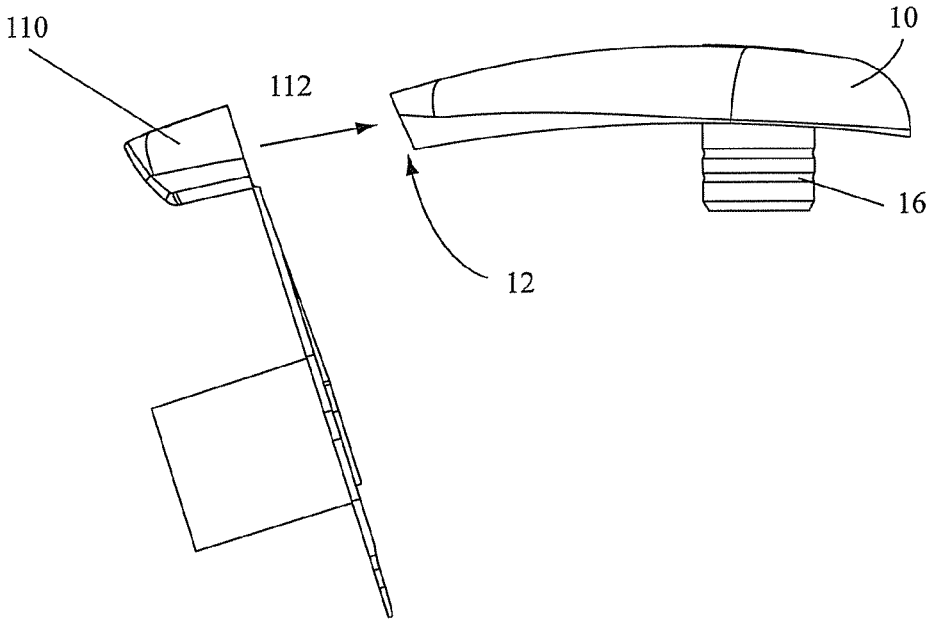
FIGS. 5A through 5C illustrate various perspective views of a tamper evident nozzle shield according to embodiments of the invention being attached to a conventional pump dispenser.
Figure 5B:
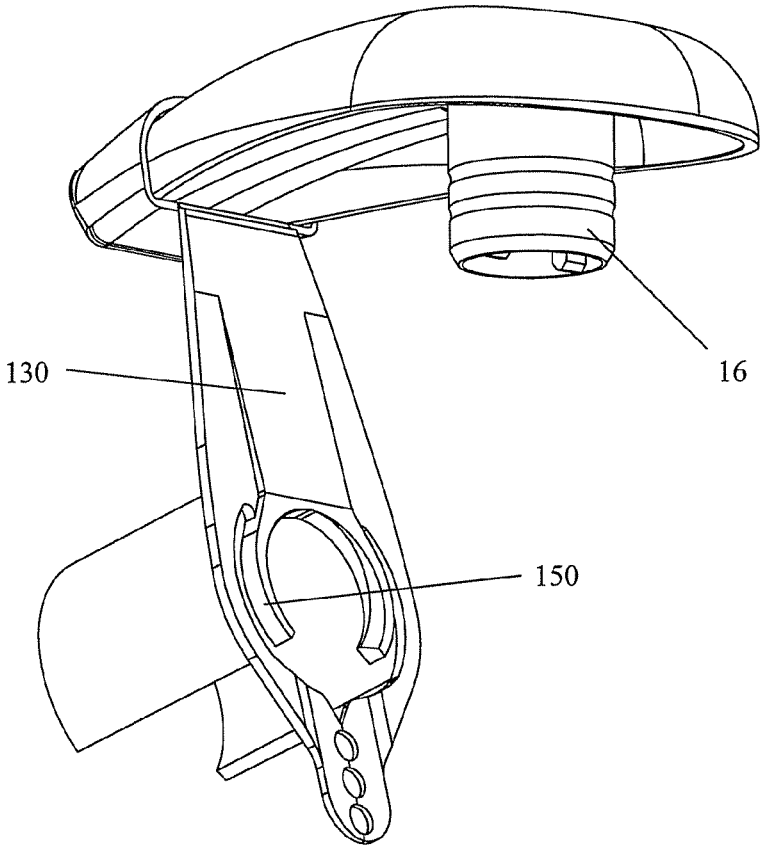
Figure 5C:
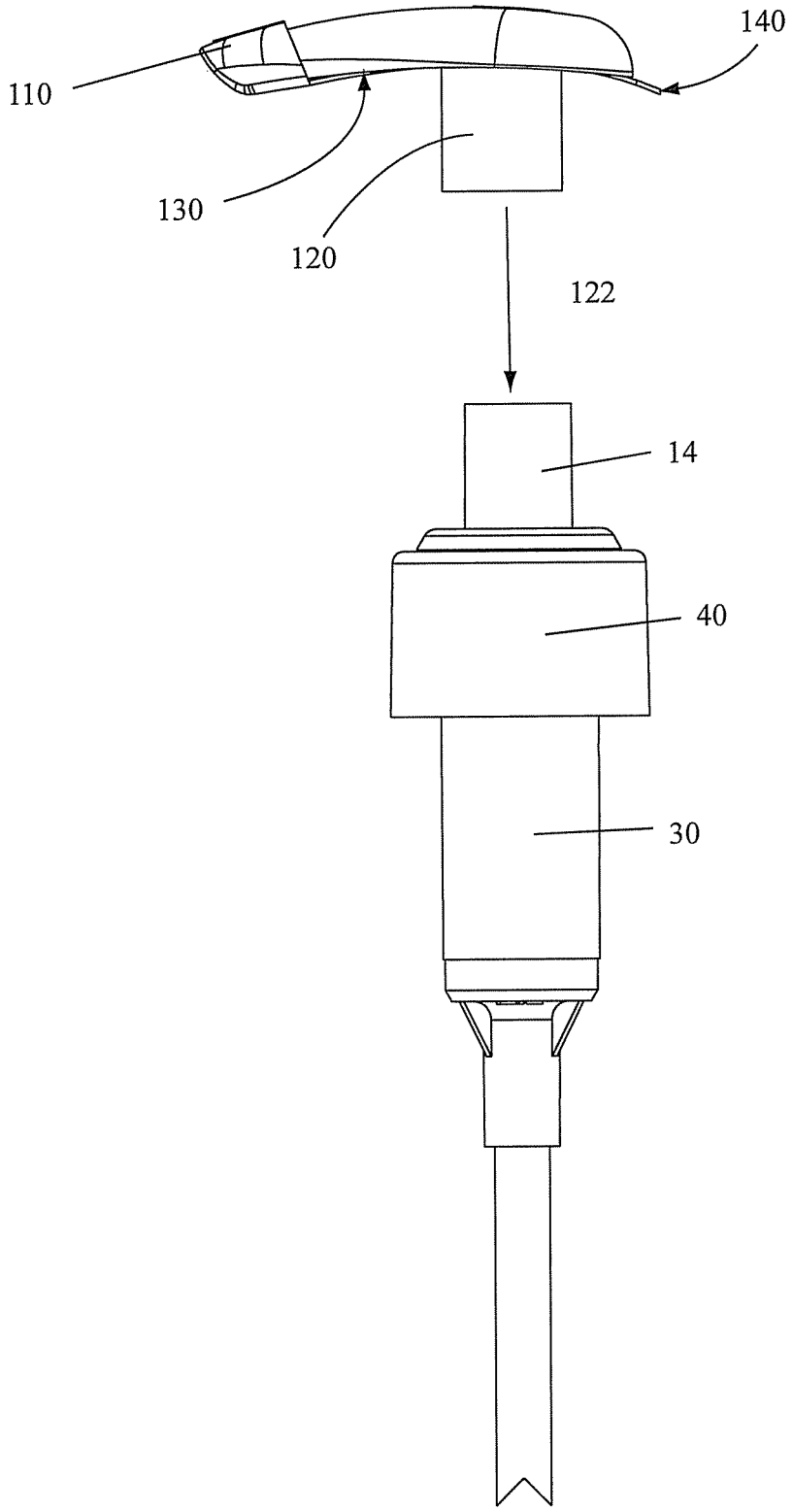

According to various embodiments of the invention, a tamper evident nozzle shield 100 or 105 may be attached to a dispenser according to the steps illustrated in FIGS. 5A, 5B, and 5C. First, as shown in FIG. 5A, dust cap 110 or 115 may be moved in direction 112 to fit over the end of nozzle 12. Next, as shown in FIG. 5B, tamper evident nozzle shield 100 or 105 may be moved in direction 132, by flexing of connecting part 130 or 135, or by other suitable movement, to bring retention ring 150 or 155 into a position grasping inner conduit 16 that is attached to the lower part of the dispenser head 10. Finally, as shown in FIG. 5C, the combined head and nozzle shield assembly may be moved in direction 122 to fit onto head skirt 14 and the other parts of the dispenser.

Tamper evident nozzle shields according to various embodiments of the invention may be attached to or configured to fit any type of dispenser and especially pump-type dispensers. For example, tamper evident nozzle shields 100 or 105 according to embodiments of the invention may be attached to dispensers that are capable of dispensing products of various viscosities such as facial creams, make-up, liposomes, special soaps for mechanics, highly viscous gels, liquid gloves, medicinal gels, and the like. The tamper evident nozzle shields according to various embodiments of the invention may also be made of any suitable material or materials. For example, the tamper evident nozzle shields 100 or 105 may be made of one or more pieces of molded plastic or other resin material.

Methods of making and using the tamper evident nozzle shields 100 of various embodiments of the invention should be readily apparent from the description as provided herein. No further discussion or illustration of such products or methods, therefore, is deemed necessary.

Having thus described certain particular embodiments of the invention, the invention is not limited to these described embodiments. Rather, the invention is limited only by the appended claims, which include within their scope all equivalent devices or methods which operate according to the principles of the invention as described.

What is claimed is:

1. A fluid dispenser, comprising:
- a container containing a fluid product;
- a dispenser attached to the container, the dispenser comprising:
  - an accumulator;
  - a pump chamber;
  - a head comprising a nozzle;
  - a head skirt;
  - a closure for attaching the dispenser to the container; and
- a tamper evident nozzle shield attached to the dispenser, the tamper evident nozzle shield comprising:
  - a dust cap;
  - a connector connected to the dust cap;
  - a tamper evident structure opposite the dust cap and removably connected to the connector by at least one breakpoint;
  - a collar attached to the connector; and
  - a retention ring extending from the connector between the dust cap and the tamper evident structure and into an interior space defined by the collar.

2. The fluid dispenser of claim 1, wherein the dust cap is configured to cover at least a portion of the nozzle.

3. The fluid dispenser of claim 1, wherein the tamper evident structure further comprises a pull-tab.

4. The fluid dispenser of claim 1, wherein the tamper evident structure further comprises a pull-tab configured to tear away from the connector along the at least one breakpoint when sufficient force is applied to the tamper evident structure.

5. The fluid dispenser of claim 1, wherein the tamper evident structure further comprises an arrow-shaped pull-tab.

6. The fluid dispenser of claim 1, wherein the tamper evident nozzle shield is a molded plastic component.

7. The fluid dispenser of claim 1, wherein the collar of the tamper evident nozzle shield is configured to encircle at least a portion of the head skirt of the dispenser and to limit movement of the head.

8. The fluid dispenser of claim 1, wherein the collar of the tamper evident nozzle shield is configured to be reattached to the dispenser.

* * * * *